US006874561B2

(12) United States Patent
Mandel

(10) Patent No.: US 6,874,561 B2
(45) Date of Patent: Apr. 5, 2005

(54) METHOD AND SYSTEM FOR CONTROLLING A CASTING PROCESS

(75) Inventor: Mark Mandel, Northbrook, IL (US)

(73) Assignee: Cast Products, Inc., Norridge, IL (US)

( * ) Notice: Subject to any disclaimer, the term of this patent is extended or adjusted under 35 U.S.C. 154(b) by 163 days.

(21) Appl. No.: 10/283,664

(22) Filed: Oct. 30, 2002

(65) Prior Publication Data

US 2004/0084168 A1 May 6, 2004

(51) Int. Cl.[7] ..... B22D 17/32

(52) U.S. Cl. ..... 164/4.1; 164/113; 164/452; 164/457; 164/154.1; 700/146; 700/202; 177/25.14

(58) Field of Search ..... 164/4.1, 113, 452, 164/457, 154.1; 700/146, 202; 177/25.14

(56) References Cited

U.S. PATENT DOCUMENTS 4,238,784 A * 12/1980 Keen et al. ..... 341/126
5,388,633 A * 2/1995 Mercer et al. ..... 164/457
6,191,371 B1 * 2/2001 Olberg et al. ..... 177/25.14
6,529,796 B1 * 3/2003 Kroeger et al. ..... 700/202

* cited by examiner

*Primary Examiner*—Kiley S. Stoner
*Assistant Examiner*—I.-H. Lin
(74) *Attorney, Agent, or Firm*—Marshall, Gerstein & Borun LLP

(57) ABSTRACT

A method (300) and a system (100) for controlling a casting process are described herein. The system (100) generally includes a die casting device (110) and a measuring device (120). The die casting device (110) includes a mold (130) configured to produce molded parts (140). The measuring device (120) may determine a position of the mold (130) within the die casting device (110) in a casting cycle. The measuring device (120) may determine an incremental increase in weight of molded parts (140) associated with the casting cycle. Based on the incremental increase in weight of molded parts (140), the measuring device (120) may provide a notification in response to a trigger event. The measuring device (120) may also reset the die casting device (110) for another casting cycle based on the incremental increase in weight of molded parts (140).

30 Claims, 3 Drawing Sheets

METHOD AND SYSTEM FOR CONTROLLING A CASTING PROCESS

TECHNICAL FIELD

The present disclosure relates to die casting processes, and more particularly, to a method and a system utilizing a digital scale for controlling a die casting process.

BACKGROUND

Die casting devices are used to form molten material such as metal into shapes to produce molded parts. A die casting device may operate to bring mold portions together to form a mold cavity and associated sprues, runners, vents, cooling lines, etc. Prior to bringing the mold portions together, a release agent or mold coating is applied to the mold cavity portions to facilitate the removal of the molded part from the mold cavity. That is, the die casting device brings the mold portions together, molten material is injected into the mold cavity, and the molten material solidifies within the mold cavity to form the molded part. To release the molded part, the mold cavity is opened and ejector pins engage the molded part.

Typically in a die casting process, the molded part is discharged into a mechanical scale to determine whether the molded part has been ejected form the mold cavity. In particular, the mechanical scale measures the weight of the molded part. If the measured weight is correct then the mold cavity is empty so that the die casting device may be reset for another casting cycle to form a new part, and the mechanical scale is emptied and readied to receive the next molded part. Sometimes, however, the molded part may be jammed or lodged on the mechanical scale. Thus, the mechanical scale will provide an indication that a completed part has been ejected form the mold even though the mold cavity has not been cleared. As a result, if the die casting device is reset to produce another part prior to clearing the mold cavity, the mold will be damaged when it is closed to form the next part. Naturally, this leads to increased cost and loss of production. The die casting machine may also be reset because the mechanical scale may be manipulated by applying pressure to the measuring plate. Again, if the mold has not been cleared before the die casting machine is reset it may become damaged during the next cycle. The mechanical scale may also operate slower than the die casting device. Thus, the mechanical scale becomes a bottleneck in the casting process. Further, the mechanical scale may be unable to provide an accurate measure of product quality and production count. Therefore, a need exists for a more accurate and effective means to control a casting process based on the weight of molded parts from the die casting device.

BRIEF DESCRIPTION OF THE DRAWINGS

This disclosure will be described in terms of several embodiments to illustrate its broad teachings. Reference is also made to the attached drawings.

DETAILED DESCRIPTION

A method and a system for controlling a casting process are described herein. The system generally includes a die casting device and a measuring device. The die casting device includes a mold configured to produce molded parts. The measuring device includes a user interface, a measuring platform, a force measurement sensor, and a controller. The force measurement sensor may be a load cell operatively coupled to the measuring platform to determine the weight of molded parts produced from the mold of the die casting device. For example, a collection bin may be disposed on the measuring platform to hold molded parts ejected from the mold. Based on the weight of molded parts, the load cell may provide a digital output signal to the controller. The controller may be operatively coupled to the user interface, the force measurement sensor, and the die casting device. The controller may determine a position of the mold within the die casting device. For example, the mold may be in a closed position so that molten material such as metal may be injected into the mold to form a molded part. Upon forming the molded part, the mold may be in an open position to eject the molded part into the collection bin. The controller may determine a weight of molded parts following each casting cycle (i.e., molding cycle). Based on the incremental increase in weight of molded parts following a casting cycle, the controller may provide a notification indicating the mold has been cleared, i.e., the molded part has been ejected properly from the mold and is not jammed or lodged in the mold. Should the mold not be properly cleaned, the controller may provide a notification. The notification may be, but is not limited to, an audio alert (i.e., an alarm, a siren, or a voice message) or a visual alert (i.e., a blinking and/or flashing light, a text message, or a video message). The controller may also suspend further operation of the die casting machine until it has been inspected and manually reset. The controller may also provide a notification if the weight of an individual molded part is incorrect (i.e., the incremental increase in weight of molded parts exceeds a range of a predetermined weight). Further, the controller may also provide a notification when the collection bin is full based upon a total accumulated weight of molded parts.

Figure 1:
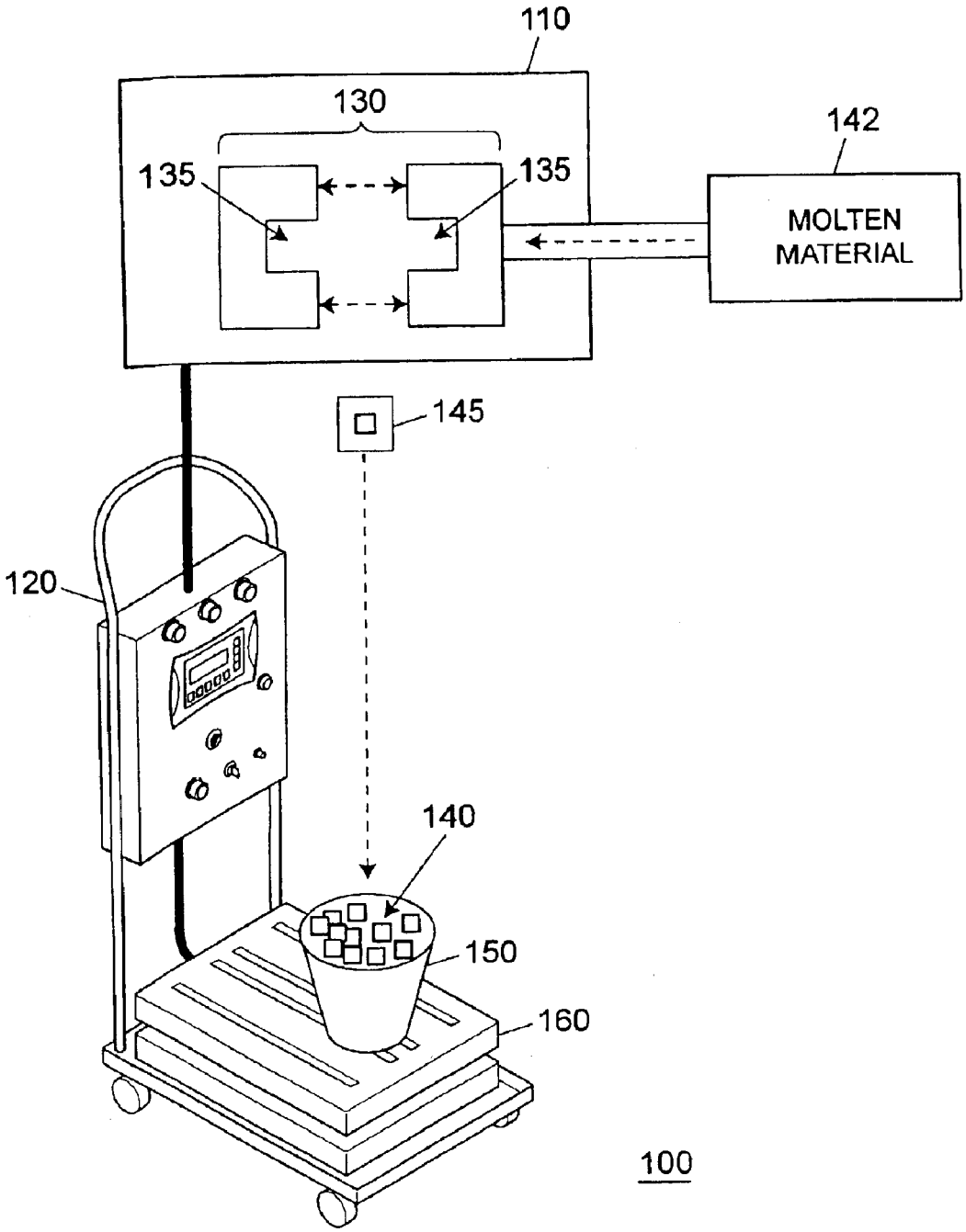
FIG. 1 is a schematic diagram representation of a system for controlling a casting process.

Referring to FIG. 1, a system 100 for controlling a casting process that generally includes a die casting device 110 and a measuring device 120. Typically, the die casting device 110 includes a mold 130 having a mold cavity 135. The mold 130 is configured to produce molded parts 140 from molten material 142 such as, but not limited to, metal and plastic. An individual molded part 145 may be ejected into a collection bin 150, which in turn, may be placed on a measuring platform 160 of the measuring device 120.

Figure 2:
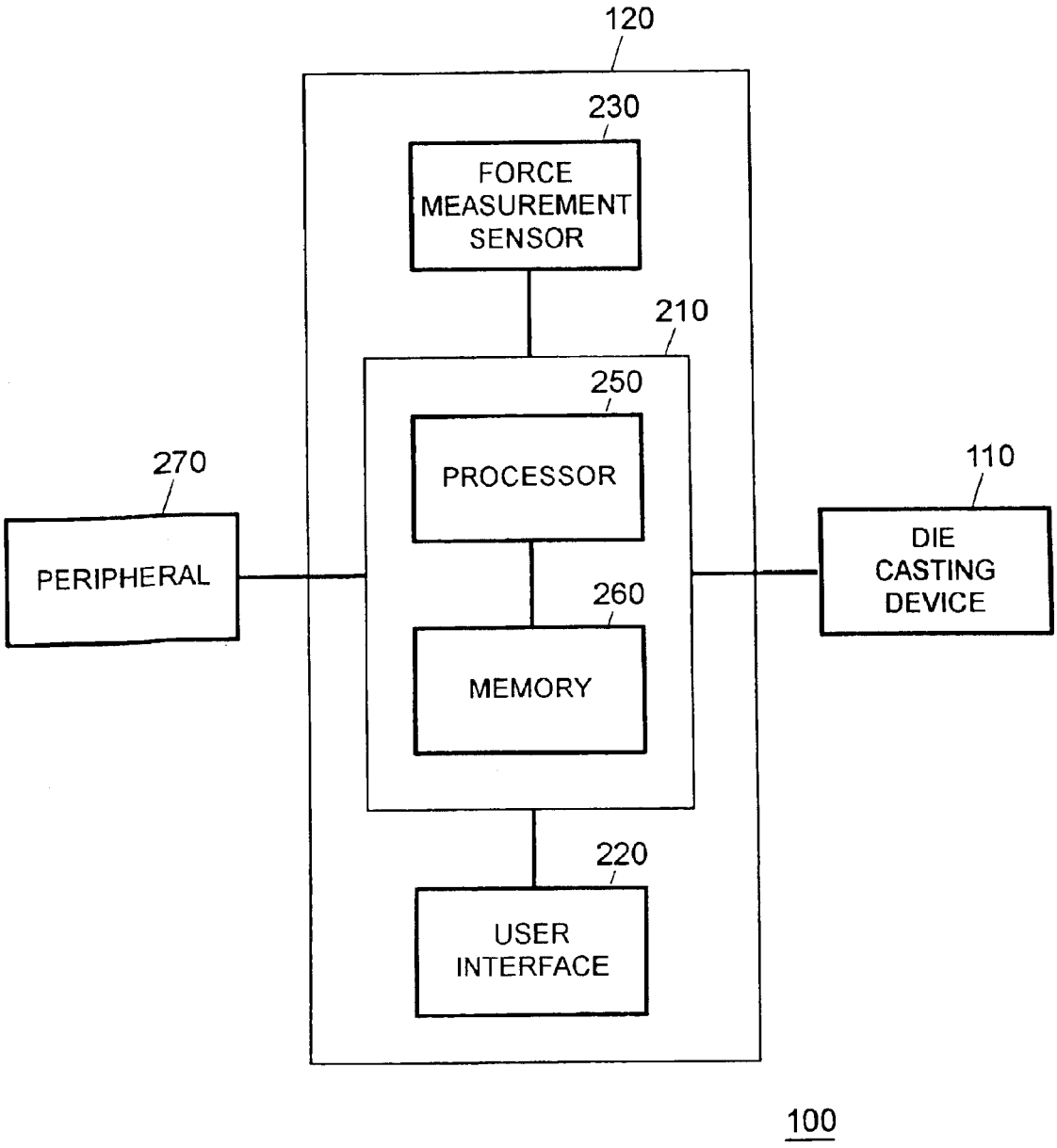
FIG. 2 is a block diagram representation of a digital measuring device.

Referring to FIG. 2, the measuring device 120 generally includes a controller 210, a user interface 220, and a force measurement sensor 230. The controller 210 includes a processor 250 and a memory 260. The processor 250 is operatively coupled to the memory 260, which stores a program or a set of operating instructions for the processor 250. The processor 250 executes the program or the set of operating instructions such that the system 100 operates as described herein. The program of the set of operating instructions may be embodied in a computer-readable medium such as, but not limited to, paper, a programmable gate array, an application specific integrated circuit (ASIC), an erasable programmable read only memory (EPROM), a read only memory (ROM), a random access memory (RAM), a magnetic media, and an optical media. The user interface 220 may be, but is not limited to, a liquid-crystal display (LCD), a touch-sensitive screen, a push button, and a joystick. The force measurement sensor 230 may be disposed within the measuring platform 160. In particular, the force measurement sensor 230 may be, but is not limited to, a strain gauge load cell operable to provide a digital output signal to the controller 210. Accordingly, the measuring device 120 may be a digital scale.

A basic flow of the system 100 may start with the measuring device 120 determining a position of the mold 130 within the die casting device 110. In a casting cycle, the mold 130 may be in a closed position so that molten metal may be injected into the mold 130 to be shaped into molded parts 140. The mold 130 may alternately be in an open position to eject the molded part 145 into the collection bin 150 to complete the casting cycle. To determine whether the molded part 145 has been properly ejected from the mold 130 and whether to reset the die casting device 110 for another casting cycle, the measuring device 120 may determine the weight of molded parts 140 in the collection bin 150 during the casting cycle. That is, the measuring device 120 may determine the incremental weight of molded parts 140 in the bin 150 after each casting cycle.

Once the mold is opened as described above, the molded part 145 is ejected into the collection bin 150. Thus, the weight of the collection bin increases by the amount of weight of the ejected part. Accordingly, the measuring device 120 may determine the weight added to the bin 150 because of the weight of the molded part 145, i.e., an incremental increase in weight of molded parts $\Delta W$.

The measuring device 120 may compare the incremental increase in weight of molded parts $\Delta W$ to a range associated with a predetermined weight PW (i.e., $PW_{min} \leqq \Delta W \leqq PW_{max}$). As part of the initial setup of the measuring device 120, the predetermined weight PW may be an average weight of a number of molded parts varying from a couple of molded parts to a continuous sample of molded parts. To increase precision of the predetermined weight PW, a user may increase the number of molded parts sampled via the user interface 220 to determine the predetermined weight PW. For example, the measuring device 120 may calibrate the predetermined weight PW following each casting cycle. Further, the user may also increase/decrease tolerance (e.g., a percentage of deviation from the predetermined weight PW) via the user interface 220 to optimize product quality (i.e., $PW_{min}$ and $PW_{max}$ may be adjusted by the user).

If the incremental increase in weight of molded parts $\Delta W$ is within the range associated with the predetermined weight (i.e., $PW_{min} \leqq \Delta W \leqq PW_{max}$), then measuring device 120 may reset the die casting device 110 for another casting cycle. Otherwise, the measuring device 120 may provide a notification to indicate that the weight of the individual molded part 145 is incorrect (i.e., underweight) because the incremental increase in weight of molded parts $\Delta W$ failed to meet the tolerance of the predetermined weight (i.e., $PW_{min} > \Delta W$ and $\Delta W > PW_{max}$). In particular, the notification may be, but is not limited to, an audible alarm, a visible light, a text message, and a video message.

The measuring device 120 may also provide a notification to indicate that the die casting device 110 may not be operating properly. For example, the molded part 145 may not have been properly ejected from the mold 130. Because of the additional weight of the molded part 145, the incremental increase in weight of molded parts $\Delta W$ should be with the range associated with a predetermined weight PW (i.e., $PW_{min} \leqq \Delta W \leqq PW_{max}$). Accordingly, if the measuring device 120 detects that the mold 130 shifted from the closed position to the open position but the incremental increase in weight of molded parts $\Delta W$ has not increased by the anticipated amount, i.e., PW, then the measuring device 120 may provide a notification to indicate that the individual molded part 145 may not have been properly ejected from the mold 130 (i.e., jammed or lodged in the mold 130). For example, if the incremental increase in weight of molded parts $\Delta W$ is zero (0) then that may indicate that the molded part 145 may jammed or lodged in the mold 130.

In addition to providing a notification for incorrect weight or improper ejection, the measuring device 120 may provide a notification to indicate other events. For example, the measuring device 120 may provide a notification in response to the collection bin 150 being full. That is, the measuring device 120 may determine whether a total accumulated weight of molded parts $W_{total}$ exceeds a threshold weight $W_{threshold}$, which may correspond to a weight of the collection bin 150 when it is full of molded parts 140. If the measuring device 120 determines that the total accumulated weight of molded parts $W_{total}$ is greater than to the threshold weight $W_{threshold}$ (i.e., $W_{total} > W_{threshold}$), then the measuring device 120 may provide a notification that the collection bin 150 may need to be emptied.

Persons of ordinary skill in the art will readily appreciate that the measuring device 120 may be calibrated such that the total accumulated weight of molded parts $W_{total}$ may not include the weight of the collection bin 150. That is, the measuring device 120 may determine that the total accumulated weight of molded parts $W_{total}$ to be zero (0) when the collection bin 150 is empty.

The measuring device 120 may also provide a warning that the bin will be full in a number of minutes or a number of parts. For example, the measuring device 120 may provide a "two-minute warning" to indicate that the bin will be full in two minutes. In another example, the measuring device 120 may indicate that the bin will be full after five more molded parts. The measuring device 120 may also keep track of the number of parts made and thus the production count of parts.

Further, the measuring device 120 may provide information associated with the casting cycle to a peripheral 270 such as, but not limited to, a printer, a handheld computer, and a personal digital assistant (PDA). The measuring device 120 may be operatively coupled to the peripheral 270. After a number of casting cycles, for example, the measuring device 120 may provide a print out via a printer so that a user may adjust the tolerance of the predetermined weight PW to achieve less porosity with the weight of molded parts 140 based on the information on the print out.

Figure 3:
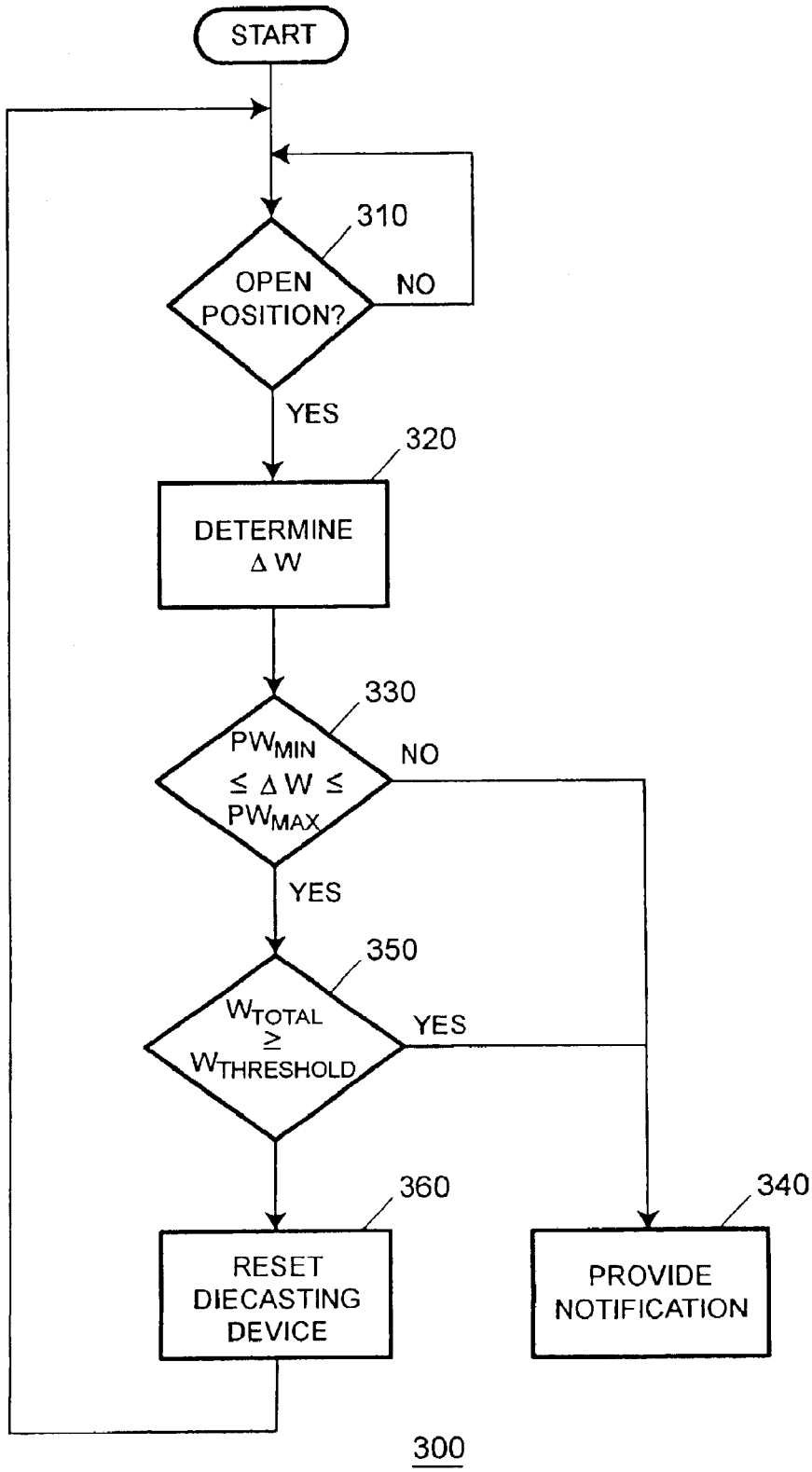
FIG. 3 is a flow diagram representation of a method for controlling a casting process.

One possible implementation of the computer program executed by the measuring device 120 (e.g., via the controller 210) is illustrated in FIG. 3. Persons of ordinary skill in the art will appreciate that the computer program can be implemented in any of many different ways utilizing any of many different programming codes stored on any of many computer-readable mediums such as a volatile or nonvolatile memory or other mass storage device (e.g., a floppy disk, a compact disc (CD), and a digital versatile disc (DVD)). Thus, although a particular order of steps is illustrated in FIG. 3, persons of ordinary skill in the art will appreciate that these steps can be performed in other temporal sequences. Again, the flow chart 300 is merely provided as an example of one way to program the measuring device 120 to control a casting process. The flow chart 300 begins at step 310, wherein the measuring device 120 determines the position of a mold of a die casting device. In a closed position of a casting cycle, molten material (e.g., metal or plastic) may be injected in to the mold to be shaped into molten parts whereas in an open position of the casting cycle, the mold may eject the molded part into a collection bin placed on a measuring platform of the measuring device 120. Accordingly, the measuring device 120 at step 320 may determine the weight of molded parts in the collection bin during the casting cycle. In particular, the measuring device 120 may determine an incremental increase in weight of the molded parts $\Delta W$ in a collection bin after each casting cycle. The measuring device 120 may determine the incremental increase in the weight of molded parts $\Delta W$ based on a digital output signal from a load cell. The load cell is configured to measure the weight of molded parts from a mold of a die casting device. Upon detecting a completed casting cycle (i.e., the mold is in the open position to eject a molded part into the collection bin), for example, the measuring device 120 may determine a first weight $W_1$. That is, the first weight $W_1$ may be associated with the weight of molded parts after to the casting cycle. To determine the incremental increase in weight of molded parts $\Delta W$, the measuring device 120 may compare the first weight $W_1$ with a second weight $W_2$. The second weight $W_2$ may be associated with the weight of molded parts prior to the casting cycle. Accordingly, the measuring device 120 may determine the incremental increase in weight of the molded parts based on the first and second weights (i.e., $\Delta W=W_1-W_2$).

Based on the incremental increase in weight of the molded parts $\Delta W$, the measuring device 120 at step 330 may determine whether the molded part has been ejected properly from the mold. In particular, the measuring device 120 may compare the incremental increase in weight of the molded parts $\Delta W$ to a predetermined weight PW. To compensate for potential measurement error by the load cell, the predetermine weight PW may include a tolerance level such that the measuring device 120 may determine whether the incremental increase in weight of the molded parts $\Delta W$ is within a range of the predetermined weight PW (i.e., $PW_{min} \leqq \Delta W \leqq PW_{max}$). If the incremental increase in weight of the molded parts $\Delta W$ is outside a range of a predetermined weight (i.e., $PW_{min}>\Delta W$ or $PW_{max}<\Delta W$ ) then the measuring device 120 may proceed to step 340 to provide a notification to indicate that the molded part may be jammed in the mold or underweight. For example, the measuring device 120 may provide an audio alert (i.e., an alarm, a siren, or a voice message) or a visual alert (i.e., a blinking and/or flashing light, a text message, or a video message). On the other hand, if the incremental increase in weight of the molded parts $\Delta W$ is within the range of the predetermined weight PW (i.e., $PW_{min} \leqq \Delta W \leqq PW_{max}$) then the die casting device may be operating properly.

At step 350, the measuring device 120 may determine whether a collection bin of molded parts is full. That is, the measuring device 120 may determine whether a total accumulated weight of molded parts (i.e., $W_1$) is greater than a weight threshold $W_{threshold}$. If the weight of molded parts is greater than a weight threshold $W_{threshold}$ (e.g., $W_1>W_{threshold}$) then the measuring device 120 may proceed to step 340 to provide a notification indicating that the collection may need to be emptied. Otherwise, the measuring device 120 at step 360 may reset the die casting device for another casting cycle to produce a molded part with the mold.

Although the embodiments disclosed herein are particularly well suited for use with a die casting device in a casting process of metal or plastic, persons of ordinary skill in the art will readily appreciate that the teachings of this disclosure are in no way limited to such a device. On the contrary, persons of ordinary skill in the art will readily appreciate that the teachings of this disclosure can be employed with other processes.

Many changes and modifications to the embodiments described herein could be made. The scope of some changes is discussed above. The scope of others will become apparent from the appended claims.

What is claimed is:

1. A method for controlling a casting process, wherein the casting process includes a die casting device having mold portions configured to produce molded parts, the method comprising:

determining a position of the mold portions within the die casting device in a casting cycle;

determining an incremental increase in weight of molded parts associated with the casting cycle;

providing a notification in response to a trigger event based on the incremental increase in weight of molded parts; and resetting the die casting device for another casting cycle based on the incremental increase in weight of molded parts.

2. The method of claim 1, wherein the step of determining a position of the mold portions within the die casting device in a casting cycle comprises detecting the mold potions being in one of a closed position and an open position in the casting cycle.

3. The method of claim 1, wherein the step of determining an incremental increase in weight of molded parts associated with the casting cycle comprises determining the incremental increase in weight of molded parts via a load cell within a measuring platform.

4. The method of claim 1, wherein the step of determining the an incremental in weight of molded parts associated with the casting cycle comprises:

determining a first weight of molded parts, the first weight being prior to the casting cycle;

determining a second weight of molded parts, the second weight being after the casting cycle; and calculating the incremental increase in weight of molded parts based on the first and second weights.

5. The method of claim 1, wherein the step of providing a notification in response to a trigger event based on the incremental increase in weight of molded parts associated with the casting cycle comprises providing a notification in response to the incremental increase in weight of molded parts being outside a range of a predetermined weight.

6. The method of claim 1, wherein the step of providing a notification in response to a trigger event based on the incremental increase in weight of molded parts comprises providing a notification in response to a total accumulated weight of molded parts being greater than a weight threshold, the weight threshold being a maximum weight associated with a collection bin.

7. The method of claim 1, wherein the step of providing a notification in response to a trigger event based on the incremental increase in weight of molded parts comprises providing one of an audio alert and a visual alert in response to a trigger event based on the incremental increase in weight of molded parts.

8. The method of claim 1, wherein the step of resetting the die casting device for another casting cycle based on the incremental increase in weight of molded parts comprises resetting the die casting device in response to the incremental increase in the weight of molded parts being within a range of a predetermined weight.

9. The method of claim 1, wherein the step of resetting the die casting device for another casting cycle based on the weight of molded parts comprises providing a feedback signal to the die casting device to initiate another casting cycle to form a molded part.

10. A system for controlling a casting process, the system comprising:

a die casting device configured to produce molded parts from mold portions; and a measuring device operatively coupled to the die casting device to measure the weight of molded parts from the mold, the measuring device comprising:

a user interface;

a measuring platform configured to molded parts from the mold;

a force measurement sensor operatively coupled to the measuring platform, the force measurement sensor being configured to weigh molded parts produced from the mold; and a controller operatively coupled to the user interface, the force measurement sensor, and the die casting device, the controller comprising a processor and a memory operatively coupled to the processor, the controller being programmed to determine a position of the mold portions within the die casting device in a casting cycle;

the controller being programmed to determine an incremental increase in weight of molded parts associated with the casting cycle, the controller being programmed to provide a notification in response to a trigger event based on the incremental increase in weight of molded parts; and the controller being programmed to reset the die casting device for another casting cycle based on the incremental increase in weight of molded parts.

11. The system of claim 10, wherein the first position is a closed position and the second position is an open position.

12. The system of claim 10, wherein the force measurement sensor is a load cell within the measuring platform.

13. The system of claim 10, wherein the controller is programmed to provide a notification in response to the incremental increase in weight of molded parts being outside a range of a predetermined weight.

14. The system of claim 10, wherein the controller is programmed to provide a notification in response to a total accumulated weight of molded parts being greater than a weight threshold, the weight threshold being a maximum weight associated with a collection bin.

15. The system of claim 10, wherein the controller is programmed to reset the die casting device in response to the incremental increase in weight of molded parts being within a range of a predetermined weight.

16. The system of claim 10, wherein the controller is programmed to provide a feedback signal to the die casting device to initiate another casting cycle to form a molded part.

17. The system of claim 10, wherein the notification is one an audio alert and a visual alert.

18. The system of claim 10, wherein the user interface is one of a liquid-crystal display (LCD), a touch-sensitive screen, a push button, and a joystick.

19. In a casting process, wherein the casting process includes a die casting device having mold portions configured to produce molded parts, and wherein a processor operates in accordance with a computer program embodied on a computer-readable medium for controlling the casting process, the computer program comprising:

a first routine that directs the processor to determine a position of the mold portions within the die casting device;

a second routine that directs the processor to determine an incremental increase in weight of molded parts associated with the casting cycle;

a third routine that directs the processor to provide a notification in response to a trigger event based on the incremental increase in weight of molded parts; and a fourth routine that directs the processor to reset the die casting device for another casting cycle based on the incremental increase in weight of molded parts.

20. The computer program of claim 19, wherein the first routine comprises a routine that directs the processor to detect the mold portions being in one of a closed position and an open position.

21. The computer program of claim 19, wherein the second routine comprises a routine that directs the processor to determine an incremental increase in weight of molded parts via a load cell within a measuring platform.

22. The computer program of claim 19, wherein the second routine comprises:

a routine that directs the processor to determine a first weight of molded parts, the first weight being associated with a closed position of the mold portions;

a routine that directs the processor to determine a second weight of molded parts, the second weight being associated with an open position of the mold portions; and a routine that directs the processor to calculate the incremental increase in weight of molded parts based on the first and second weights.

23. The computer program of claim 19, wherein the third routine comprises a routine that directs the processor to provide a notification in response to the incremental increase in weight of molded parts being outside a range of a predetermined weight.

24. The computer program of claim 19, wherein the third routine comprises a routine that directs the processor to provide a notification in response to a total accumulated weight of molded parts being greater than a weight threshold, the weight threshold being a maximum weight associated with a collection bin.

25. The computer program of claim 19, wherein the third routine comprises a routine that directs the processor to provide one of an audio alert and a visual alert in response to a trigger event based on the incremental increase in weight of molded parts.

26. The computer program of claim 19, wherein the fourth routine comprises a routine that directs the processor to reset the die casting device in response to the incremental increase in weight of molded parts being within a range of a predetermined weight.

27. The computer program of claim 19, wherein the fourth routine comprises a routine that directs the processor to provide a feedback signal to the die casting device to initiate another casting cycle to form a molded part.

28. A digital measuring device operatively coupled to a die casting device used in a casting method for measuring the weight of molded parts from mold portions configured to produce the mold parts in the die casting device, the digital measuring device comprising:

a user interface;

a measuring platform configured to molded parts from the mold;

a load cell operatively coupled to the measuring platform, the load cell being configured to weigh molded parts produced from the mold; and a controller operatively coupled to the user interface, the load cell, and the die casting device, the controller comprising a processor and a memory operatively coupled to the processor, the controller being programmed to determine a position associated with the mold portions, the position being one of a closed position and an open position of a casting cycle, the controller being programmed to determine a first weight of molded parts associated with the closed position of the mold portions, the controller being programmed to determine a second weight of molded parts associated with the open position of the mold portions, the controller being programmed to determine a difference in weight between the first and second weights of molded parts, the controller being programmed to provide a notification in response to the difference in weight being outside a tolerance of a predetermined weight; and the controller being programmed to reset the die casting device for another casting cycle in response to the difference in weight being within the tolerance of the predetermined weight.

29. The digital measuring device of claim 28, wherein the controller is programmed to provide information associated with the casting cycle to a peripheral, the peripheral is one of a printer, a handheld computer, a personal digital assistant (PDA), a pager, and a cellular telephone.

30. A digital measuring device operatively coupled to a die casting device used in a casting method for measuring the weight of molded parts from mold portions configured to produce the mold parts in the die casting device, the digital measuring device comprising:

a means for determining a position of the mold within the die casting device in a casting cycle;

a means for determining an incremental increase in weight of molded parts associated with the casting cycle;

a means for providing a notification in response to a trigger event based on the incremental increase in weight of molded parts; and a means for resetting the die casting device for another casting cycle based on the incremental increase in weight of molded parts.

* * * * *

UNITED STATES PATENT AND TRADEMARK OFFICE

CERTIFICATE OF CORRECTION

PATENT NO. : 6,874,561 B2
DATED : April 5, 2005
INVENTOR(S) : Mark Mandel

It is certified that error appears in the above-identified patent and that said Letters Patent is hereby corrected as shown below:

Column 6,
Line 22, please delete “potions” and insert -- portions --.
Line 31, please delete “the an incremental in” and insert -- the incremental increase in --.

Column 7,
Lines 54-55, please delete “one an” and insert -- one of an --.

Signed and Sealed this

Twenty-third Day of August, 2005

JON W. DUDAS
*Director of the United States Patent and Trademark Office*